US008864100B2

(12) United States Patent
Ward

(10) Patent No.: US 8,864,100 B2
(45) Date of Patent: Oct. 21, 2014

(54) FORMWORK CONNECTING PIN ASSEMBLY

(76) Inventor: Philip T. Ward, Grandview, MO (US)

( * ) Notice: Subject to any disclaimer, the term of this patent is extended or adjusted under 35 U.S.C. 154(b) by 852 days.

(21) Appl. No.: 12/702,054

(22) Filed: Feb. 8, 2010

(65) Prior Publication Data

US 2011/0192956 A1 Aug. 11, 2011

(51) Int. Cl.
*E04G 17/04* (2006.01)
*E05C 1/10* (2006.01)

(52) U.S. Cl.
USPC ..... 249/196; 292/164

(58) Field of Classification Search
USPC ..... 249/47, 196; 292/143, 163, 177, 164; 403/324, 325, 327
See application file for complete search history.

(56) References Cited

U.S. PATENT DOCUMENTS

| | | | | | |
|---|---|---|---|---|---|
| 901,470 | A | * | 10/1908 | Rankins | 292/61 |
| 1,060,448 | A | * | 4/1913 | Goeden | 292/177 |
| 1,315,266 | A | * | 9/1919 | Weiland | 292/60 |
| 1,551,102 | A | * | 8/1925 | Hathaway | 292/173 |
| 1,567,210 | A | | 12/1925 | Trester | |
| 1,675,033 | A | * | 6/1928 | Lefkovitz et al. | 292/60 |
| 2,357,608 | A | * | 9/1944 | Ostrowski | 292/60 |
| 3,801,061 | A | | 4/1974 | Holt | |
| 3,877,674 | A | * | 4/1975 | Cerutti | 249/196 |
| 4,033,548 | A | * | 7/1977 | Shahar | 249/194 |
| 5,042,854 | A | * | 8/1991 | Huang | 292/175 |
| 5,058,855 | A | * | 10/1991 | Ward | 249/47 |
| 5,083,398 | A | * | 1/1992 | Kolbeck et al. | 49/395 |
| 5,083,740 | A | * | 1/1992 | Sawyer et al. | 249/219.1 |
| 5,121,950 | A | * | 6/1992 | Davidian | 292/164 |
| 5,174,909 | A | * | 12/1992 | Ward | 249/44 |
| 5,288,051 | A | * | 2/1994 | Ward | 249/196 |
| 5,685,578 | A | * | 11/1997 | Schneider | 292/144 |
| 5,690,371 | A | * | 11/1997 | Turnbull | 292/163 |
| 5,746,455 | A | * | 5/1998 | Takimoto | 292/62 |
| 5,759,429 | A | * | 6/1998 | Trimmer et al. | 249/196 |
| 7,182,308 | B2 | * | 2/2007 | Trimmer et al. | 249/196 |
| 7,878,558 | B1 | * | 2/2011 | Bell | 292/80 |

OTHER PUBLICATIONS

Precise Forms, Inc., Your Path Toward Building a Solid Future, Attached Hardware, Set-n-Lok System, Jul. 9, 2007, pp. 6-9.
Wall-Ties & Forms, Inc., Concrete Form Accessories—Attached Hardware, Wall-Ties & Forms, Inc., Shawnee, Kansas 66226, Jul. 9, 2007.

* cited by examiner

*Primary Examiner* — Michael Safavi
(74) *Attorney, Agent, or Firm* — John C. McMahon

(57) ABSTRACT

A pin assembly (20) having a substantially automatic locking and stowing mechanism, including a latch (90), a biasing member (70), and an engagement pin (30). The engagement pin includes a hollow-tipped forward end, allowing a hardened core pin insert to be introduced. The latch is operably connected to the pin assembly such that raising the latch compresses, creating an extension force, and tensions, creating a rotational force, the biasing member, and applying a force to the rearward end of the pin assembly causes the extension force to drive the engagement pin forward through aligned openings of the adjacent panels and the rotational force drops the latch securing the two panels in place. The adjacent panels are easily disconnected by raising the latch, compressing, creating an extension force, and tensioning, creating a rotational force, the biasing member, and applying a force to the forward end of the pin assembly causing the extension force to drive the engagement pin back through the aligned openings of the framework panels and the rotational force to drop and stow the latch for later use. A biased catch (75) secures the engagement pin in a retracted position.

14 Claims, 6 Drawing Sheets

FORMWORK CONNECTING PIN ASSEMBLY

FIELD OF THE INVENTION

The present invention relates to apparatuses and pins for connecting forming panels used in casting cementitious or other materials, such as concrete. More particularly, the present invention concerns pin assemblies utilizing biasing members and hardened core pin inserts.

BACKGROUND OF THE INVENTION

Formwork is used to contain and shape cementitious or other flowable material, such as concrete, during the pouring and setting, or curing, processes. One common use of formwork is in the casting of walls. Once the material has sufficiently set, the formwork is stripped, or struck, therefrom to be reused elsewhere.

Generally, formwork comprises parallel, spaced apart rows of forming panels, with each panel of a row being temporarily connected to an adjacent panel to define a side of the structure being cast. Various mechanisms have been used to accomplish the connection of adjacent forming panels, including complimentary nuts and bolts and complimentary pins and wedges. Unfortunately, these mechanisms generally suffer from a number of problems and disadvantages, including frequent loss of loose pieces and longer time and increased labor costs associated with engaging and disengaging the mechanisms in order to erect and strip the framework.

One such mechanism comprises a retractable pin and latch. When it is desired to connect adjacent panels, the retracted pin associated with a first panel is extended through a corresponding hole in the second panel. Often this is accomplished by striking the opposite end of the pin with a hammer to drive it through the at least partially aligned hole. Even in some of the most advanced apparatuses, momentum prevents the latch from properly securing the panels and the worker must manually engage the latch, with one side fitting snugly around the inside adjacent edges of both the first and second panels to prevent the inadvertent retraction of the pin and disconnection of the panels. Another step is required to move the lock into a latched position. When it is desired to disconnect adjacent panels, the engaged latch is first manually disengaged, i.e., pried up and above the inside edges of both the first and second panels to provide sufficient clearance; the pin is retracted from the corresponding hole by striking the end of the pin with a hammer. Because the pin is not connected to a housing structure, the pin occasionally bounces back and multiple strikes are required. Another problem that results from a lack of attachment to the housing structure is the pin often falls out of place and is easily lost. Because the pins must be longer within the housing to avoid this issue, the latch often does not travel far enough to properly secure the panels. This is also an issue when it is desired to retract the pin and stow the latch because the pin often does not retract all the way through the openings, or bounces back requiring several strikes. Also, these types of assemblies often do not allow the engagement pin to travel back through both panels and the worker must rotate the panels apart to effectively strip the framework. Finally, the latch is manually stowed by rotating the latch towards the now poured cementitious or other flowable material. It will be appreciated that this process requires several steps and wastes significant labor time by requiring multiple strikes and time spent looking for missing pieces of the assembly. In these and other devices, it has been generally viewed as an disadvantage to use elongated pins, or pins with increased tapering of the forward end, for initially securing the panels, both due to cost and increased mushrooming of the tip of the engagement pin. Although these assemblies are often described as one-step mechanisms, in actual use, these mechanisms often involve many additional steps, as described above, to accomplish the same goals as the present invention.

SUMMARY OF THE INVENTION

The present invention overcomes the above-discussed and other problems and disadvantages by providing an improved pin assembly having a biasing member and a latch to automatically secure the first and second panels and to ease disassembly of the formwork by automatically stowing the latch.

The present invention also overcomes the above-discussed and other problems and disadvantages by providing a hardened core pin insert that couples to an engagement pin to allow for the latch to travel the appropriate distance to secure the engagement panels and also prevents mushrooming of the tip of the engagement pin.

The present invention also overcomes the above-discussed and other problems and disadvantages by providing, in one embodiment, a biased catch that secures the engagement pin in a retracted position, allowing for disassembly with a single tool. The biased catch allows use of a shorter engagement pin, because the biased catch prevents problems associated with bounce back of the engagement pin.

In one embodiment, the pin apparatus comprises an engagement pin including a latch such that raising the latch compresses, creating an extension force, and tensions, creating a rotational force, the biasing member and a first force applied to the pin assembly releases the extension force in the biasing member driving the engagement pin through aligned openings in the panels, the rotational force dropping the latch and securing the panels to be locked into place. When the panels are ready for disassembly, raising the latch compresses, creating a retraction force, and tensions, creating a rotational force, the biasing member and a second force applied to the pin assembly releases the retraction force in the biasing member, driving the engagement pin back through the aligned openings in the panels, the rotational force dropping the latch into a stowed position.

In various implementations, the pin apparatus includes any one or more of the following additional features. The biasing member is a torsion spring to allow kinetic energy stored in the biasing member to extend or retract the engagement pin and to force the latch from a raised position to a secured or stowed position.

In one embodiment, the biasing member has a posterior tail coupled to a hole in the posterior of the housing. The biasing member, in this particular embodiment, also has an anterior tail, coupled to a groove in the engagement pin or an o-ring, in another embodiment, acting as a retaining clip coupled to the engagement pin.

In another embodiment, the biasing member has a small section and a large section, the small section fitting into a grease groove in the housing whereby raising the latch tensions the biasing member, such that the small section coils expand providing frictional engagement with the interior of the housing, locking the biasing member into a pre-loaded position. In this embodiment, the biasing member is secured by friction and there is no need for a hole in the posterior of the housing to hold the biasing member into place. The groove also facilitates the rotational movement, allowing the latch to move into a stowed or secured position.

The apparatus may include a hollow-tipped engagement pin to allow a hardened core pin insert to be introduced, coupled in one embodiment, into the hollow-tipped end of the engagement pin. In one embodiment, the additional length allows the front edge of the latch to travel beyond the edge of both panels so it snaps down securing the panels and preventing the engagement pin from moving out of place.

In one embodiment, a hollowed-out section of the horizontal axis of the engagement pin is included to allow introduction of a wedge.

The apparatus may further include an o-ring, coupled in one embodiment to a groove in the tail of the engagement pin, wherein the o-ring functions as a retainer clip to hold the rearward end of the engagement pin in the housing of the assembly. In one embodiment, the o-ring is steel so that when coupled with the engagement pin the two are locked in place and cannot come apart. This enables the engagement pin to maintain its ability to rotate, without falling out of place.

The apparatus may rely on the biasing member, in one embodiment, rather than an o-ring, to prevent the latch from falling out of the pre-loaded position until it is desired to attach or disassemble the panels.

In one embodiment, a biased catch within the housing is biased by the engagement pin on one end, and attachable to the housing on the opposing end. The biased catch holds the engagement pin in place with friction in the retracted position.

These and other features of the present invention are described in greater detail below in the section titled DETAILED DESCRIPTION.

BRIEF DESCRIPTION OF THE DRAWING FIGURES

The present invention is described herein with reference to the following drawing figures, with greater emphasis being placed on clarity rather than scale:

DETAILED DESCRIPTION

Figure 1:
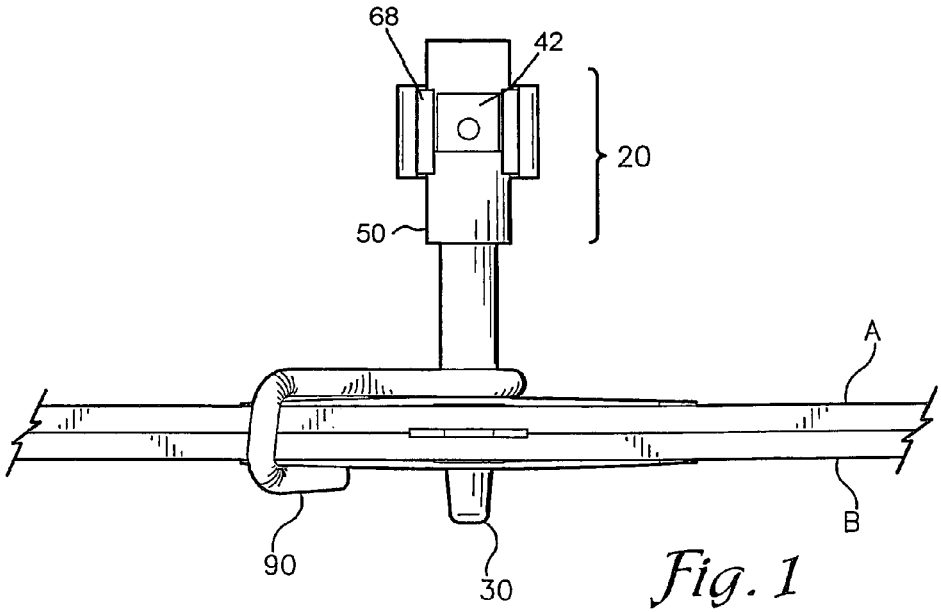
FIG. 1 is a plan view showing one embodiment of a latch securing two panels.

With reference to the drawing figures, a pin assembly 20, a latch 90, a biasing member 70, and an engagement pin 30 are herein described, shown, and otherwise disclosed in accordance with one or more embodiments, including one or more preferred embodiments, of the present invention.

More particularly, the present invention concerns a pin assembly 20 having a substantially automatic locking and stowing mechanism, including a biasing member 70, a latch 90, and an engagement pin 30.

Referring particularly to FIG. 1, the pin assembly 20 has application in temporarily connecting adjacent forming panels A,B of formwork used in casting cementitious or other material, such as concrete. Broadly characterized, the pin assembly 20 has a substantially automatic locking and stowing mechanism which requires fewer steps and, therefore, less time to erect and strip (disassemble or disconnect) the forming panels A,B.

Figure 2:
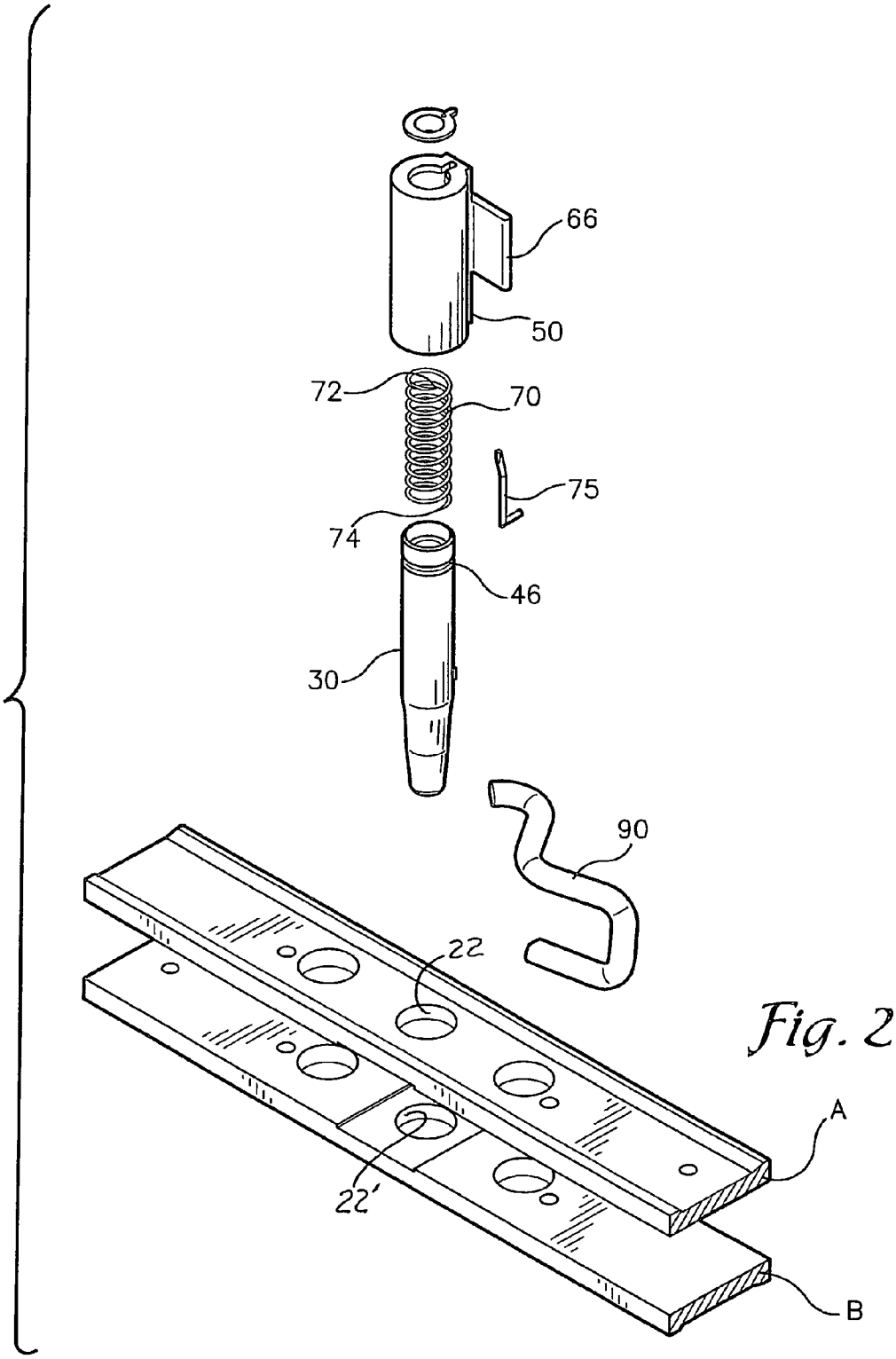
FIG. 2 is an exploded view showing one embodiment of the formwork pin assembly.

More specifically, referring also to FIG. 2, the pin assembly 20 comprises an engagement pin 30, a latch 90, and a biasing member 70 coupled, in one embodiment, on the rearward end to a housing 50 and on the rearward end of the engagement pin 30. When it is desired to connect forming panels A and B, the panels A,B, are positioned such that the engagement pin 30 is at least partially aligned with an opening in the adjacent panel, the latch 90 is raised, see FIG. 3, compressing, creating an extension force, and tensioning, creating a rotational force, in the biasing member 70, and the rearward end of the pin assembly 20 is struck, such as with a hammer, the extension force in the biasing member 70 driving the engagement pin 30 through the openings in the panels A,B, the rotational force in the biasing member 70 causing the latch 90 to drop, thereby substantially automatically securing the forming panels A,B together.

Figure 4:
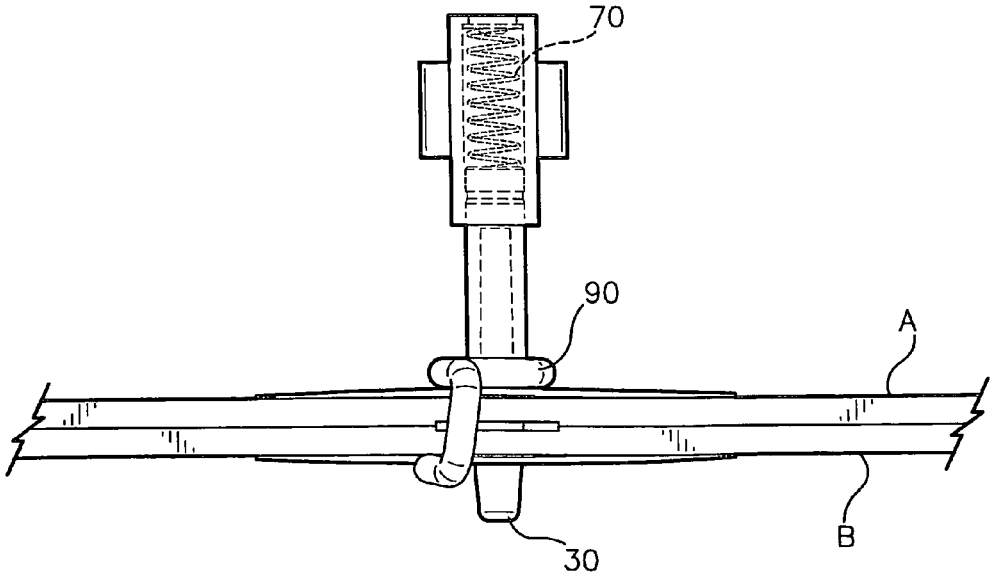
FIG. 4 is a plan view of one embodiment with the panels secured and the latch pre-loaded.

Thereafter, referring also to FIG. 4, when it is desired to disassemble or disconnect the forming panels A,B, the latch 90 is raised, compressing, creating a retraction force, and tensioning, creating a rotational force, the biasing member 70, the forward end of the engagement pin 30 is struck, such as with a hammer, the retraction force in the biasing member 70 driving the engagement pin 30 back through the openings in the panels A, B, the rotational force in the biasing member 70 causing the latch 90 to drop, thereby substantially automatically stowing the latch.

Figure 5:
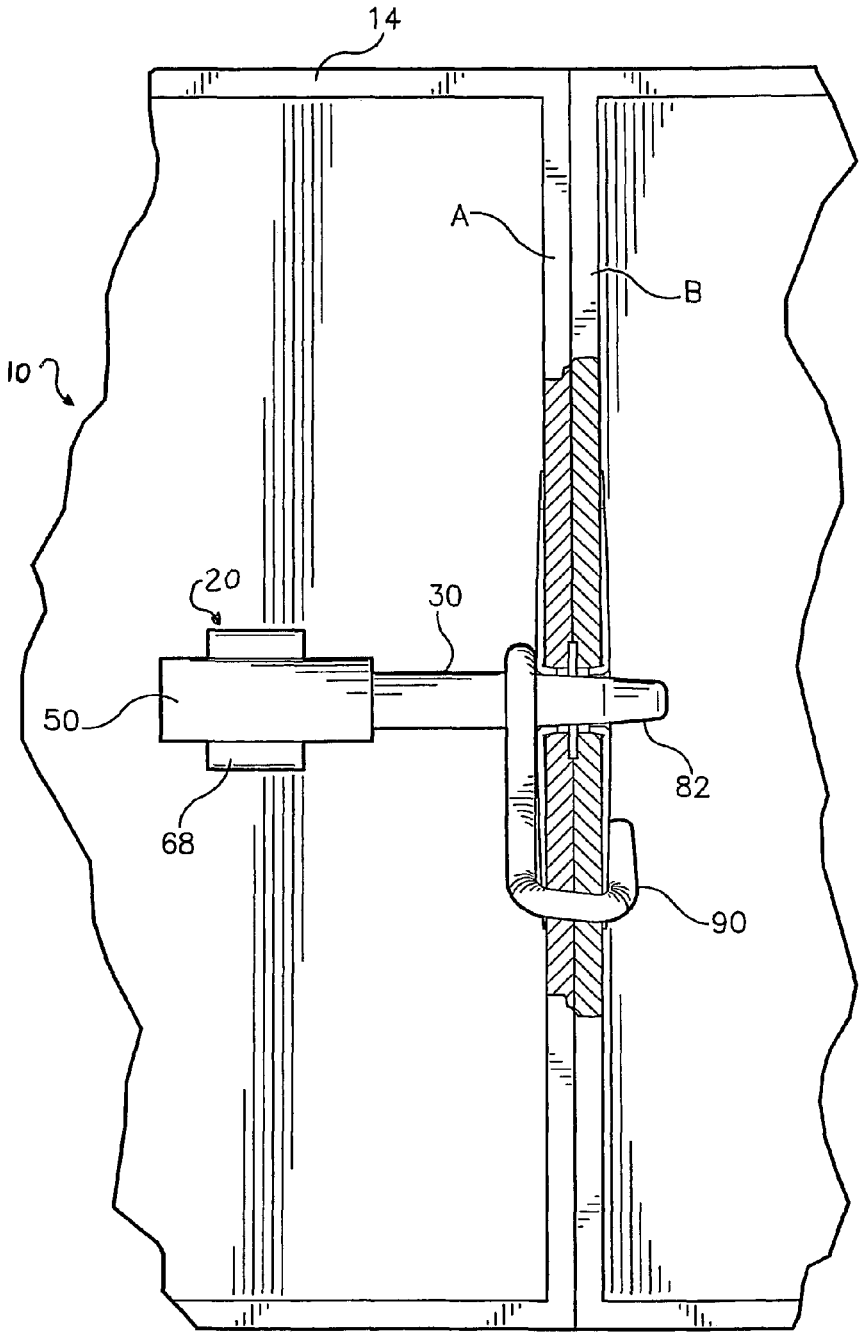
FIG. 5 is a plan view of one embodiment of two adjacent panels secured in one embodiment of the invention.

Referring particularly to FIG. 5, the apparatus 10 may comprise a pin assembly 20 and a mounting structure 14. The pin assembly 20 may include a housing 50, an engagement pin 30, a biasing member 70, and a latch 90. The form panel A would constitute a mounting structure 14 to which the pin assembly 20 is mounted, and the pin assembly 20 is operable to extend and retract in such a manner as to releasably engage the adjacent second forming panel B.

The mounting structure 14 supports the pin assembly 20 in its operating positions, i.e., both its locked and unlocked positions. The form panel is, in effect, a five sided box with the frame forming four sidewalls and the form panel face forming the bottom, and a receiver 68. The receiver 68 may be affixed to the bottom of the mounting structure 14 and slidably receives flanges 66 of the mounting plate 42 of the housing 50 of the pin assembly 20. There may be a plurality of such receivers, or at least one receiver with a plurality of positions for receiving the pin assembly 20. The panel A adjacent and opposite the receiver has at least one opening 22 through which the engagement pin 30 extends and retracts. Where there are a plurality of receivers or multiple positions for receiving the pin assembly 20, there are multiple corresponding openings 22 in the panel A for the engagement pin 30. The panel B may also each present at least one such opening 22' for engagement pins 30.

Figure 8:
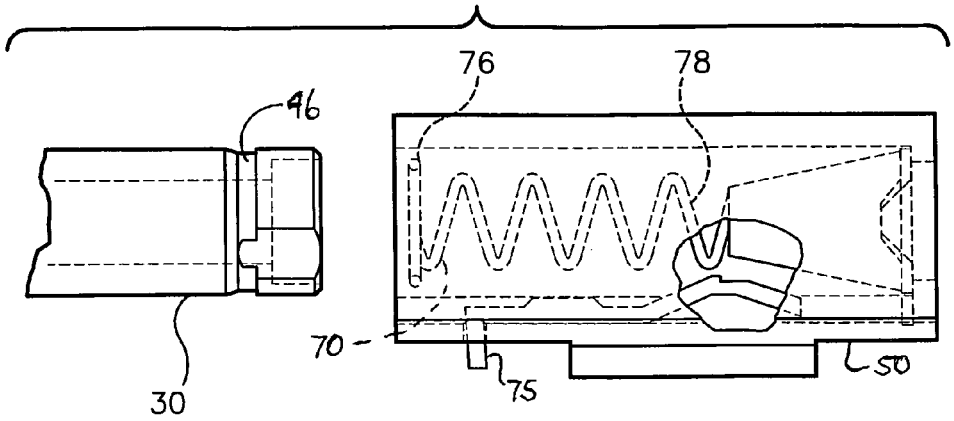
FIG. 8 is a plan view of one embodiment of a biasing member with a small section and a large section.

The biasing member 70 is operable to bias the engagement pin 30 and latch 90 in a normally forward direction relative to the housing 50 and the mounting structure 14. Referring to FIG. 8, in one embodiment, the biasing member 70 has a small section 78 and a large section 76, the small section 78 fitting into a grease groove (not shown) in the housing 50 whereby raising the latch tensions the biasing member 70, such that the small section 78 coils expand providing frictional engagement with the interior of the housing 50, locking the biasing member into a pre-loaded position. In this embodiment, the biasing member 70 is secured by friction and there is no need for a hole in the posterior of the housing to hold the biasing member 70 into place. The groove also facilitates the rotational movement, allowing the latch 90 to move into a stowed or secured position.

The pin assembly 20 is operable to physically engage and disengage an adjacent forming panel, tie, or other structure. Referring particularly to FIG. 5, the pin assembly 20 includes the engagement pin 30 and the latch 90. The engagement pin 30 is operable to slidably engage and disengage the second panel B. The engagement pin 30 may be substantially elongated. The head end 82 may be tapered, e.g., substantially frustoconical, in shape in order to facilitate clearing the head end 82 when it desired to separate the panels A,B.

Referring particularly to FIG. 2, a plate (not shown) in the rearward end of the housing 50 has a hole suitably designed, in one embodiment, to receive a rearward tail 72 of the biasing member 70. The biasing member 70 also has a forward tail 74, in another embodiment, coupled to a groove 46 in the engagement pin 30. In this embodiment, an o-ring may act as a retainer clip to hold the rearward end 72 of the engagement pin 30 in the housing 50 to prevent the pin assembly 20 from falling apart. In a preferred embodiment, the o-ring is coupled to the engagement pin 30 by cutting a groove 46 in the rearward end of the engagement pin 30. In one embodiment, the o-ring is made of steel so that the o-ring and engagement pin 30 are locked into place.

The pin assembly 20 is designed, in one embodiment, without the need for a second o-ring preventing the latch 90 from falling out of place. Instead, the assembly 20 relies on the biasing member 70 to prevent the latch 90 from falling out of place.

Figure 6:
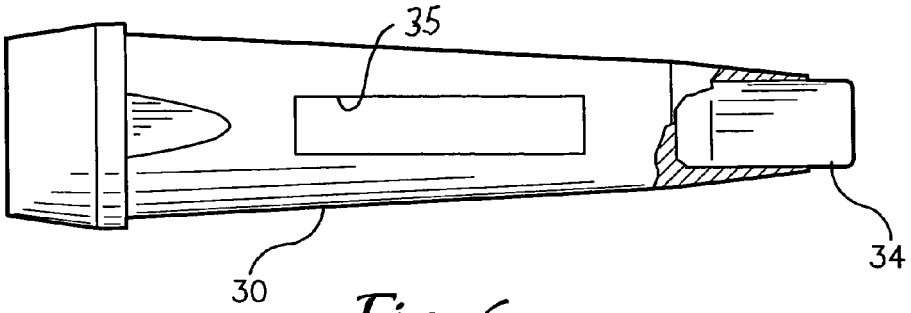
FIG. 6 is an elevation view of one embodiment of a hollow-tipped engagement pin with insert and retrofitted for use with a wedge.
Figure 7:
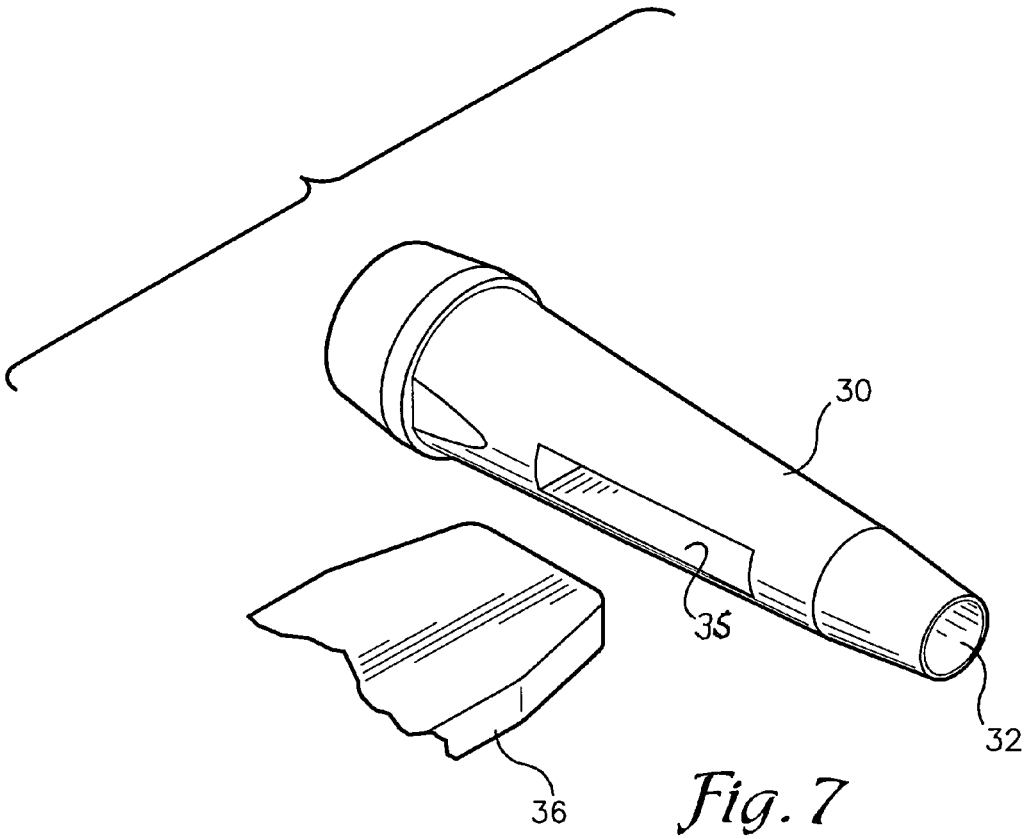
FIG. 7 is an isometric view of one embodiment of an engagement pin retrofitted for use with a wedge, a hollow-tipped end for use with an insert, and a wedge.

Referring to FIGS. 6 and 7, the engagement pin 30 is, in one embodiment, hollow-tipped such that a hardened core pin insert 34 is introduced. In a preferred embodiment, the hardened core pin insert 34 is coupled to the hollow-tipped end 32 of the engagement pin 30. The resulting elongated pin is viewed by those reasonably skilled in the art as a disadvantage due to increased mushrooming and cost. However, the addition of the pin insert 34 solves the long-felt, but unresolved problem of mushrooming of the pin. In actual tests, the pin insert 34, after two thousand cycles, approximately equal to ten years of use, displays no signs of mushrooming. By contrast and also in actual tests, the standard engagement pin without a pin insert 34, displays significant signs of mushrooming after only two hundred cycles, or approximately one year of use. Although it is recognized that increased tapering of the forward end of the engagement end coupled with the forces exerted by the cementitious material held in place by the formwork assists with the retracting of the engagement pin, however those skilled in the art are not able to utilize increased tapering in actual practice, because mushrooming of the tip is greatly exaggerated by increased tapering. The additional length also allows the latch 90 to travel the appropriate distance to properly secure the forming panels A, B.

In another embodiment, the engagement pin 30 includes a hollowed-out section 35 along its horizontal axis, as seen in FIG. 7, to allow a wedge 36 to be introduced to the apparatus. Wedges 36 are known to those reasonably skilled in the art to help secure and prevent the engagement pin 30 from inadvertent retraction.

In another embodiment, shown in FIG. 8, a biased catch 75, within the housing is biased by the engagement pin 30 on one end and attachable to the housing 50 on the opposing end. In one embodiment, the biased catch is made of spring steel. When it is desired to unlock the first and second forming panels A,B, the latch 90 is struck, such as with a hammer, and the forward end of the engagement pin 30 is struck, again with a hammer, driving the engagement pin 30 back through the openings in the panels and unlocking the panels, whereby the biased catch 75 holds the engagement pin 30 in place with friction, preventing the engagement pin 30 from backing out. In this embodiment, there is no need for the biasing member 70 to be in torsion. Thus, the biased catch 75 allows for disassembly with a single tool, whereas previous formwork assemblies require the use of a hammer to knock down the clamp and a screwdriver to pry the clamp back. Actual tests have shown that by utilizing the biased catch 75, the formwork can be stripped approximately twice as fast as the previous formwork assemblies because a single tool can be used and because the biased catch 75 prevents the engagement pin 30 from bouncing back, a common problem with previous formwork assemblies that necessitates multiple strikes with a hammer.

Figure 3:
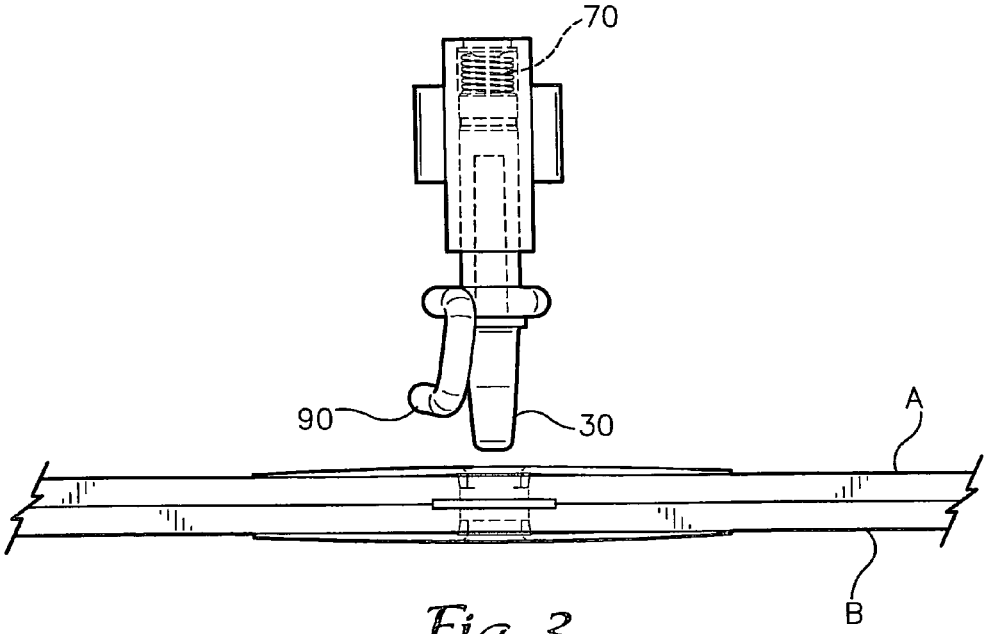
FIG. 3 is a plan view of one embodiment with the panels unsecured and the latch pre-loaded.

In exemplary use and operation, the apparatus 10 of the present invention may be used and function substantially as follows. Referring again to FIG. 5, the form panel A constitutes the mounting structure 14 and the pin assembly 20 is coupled with the mounting structure 14, the engagement pin 30 is in its fully retracted position, i.e., and the latch 90 is fully raised, compressing the biasing member 70, creating an extension force, and tensioning the biasing member, creating a rotational force as seen in FIG. 3. The first panel A is positioned such that the opening in the mounting structure 14 through which the engagement pin 30 will extend is aligned with a corresponding opening in the second panel B. When it is desired to lock the first and second forming panels A,B together, the rearward end of the pin assembly 20 is struck, such as with a hammer, the extension force in the biasing member driving the engagement pin through the openings in the panels, whereby the rotational force in the biasing member causes the latch to drop, thereby securing the forming panels A,B. At this point, the first and second forming panels A,B are now secured, as seen in FIGS. 1 *and* 5. This process is repeated for each pair of adjacent forming panels until the framework is fully assembled.

When it is desired to unlock the first and second forming panels A,B, the latch 90 is raised, as seen in FIG. 4, compressing the biasing member 70, creating a retracting force, and tensioning the biasing member, creating a rotational force, the forward end of the engagement pin 30 is struck such as with a hammer, the retraction force in the biasing member 70 driving the engagement pin 30 back through the openings in the panels, disconnecting the panels, whereby the rotational force in the biasing member causes the latch 90 to drop, thereby substantially automatically stowing the latch 90. At this point, the first and second forming panels A,B are disconnected. This process is repeated for each pair of adjacent forming panels until the framework is fully disassembled.

In one application, the pin assembly 20 is provided by itself, i.e., separate from any mounting structure 14, so that it can be used, as desired, to make spot connections at particular points on the panels A,B, such as at the bottom of the formwork where pressures due to the weight of the poured material are greatest.

Although the invention has been disclosed with reference to various particular embodiments, versions, and implementations, it is understood that equivalents may be employed and substitutions made herein without departing from the scope of the invention as recited in the claims.

Having thus described the preferred embodiment of the invention, what is claimed as new and desired to be protected by Letters Patent includes the following:

1. An apparatus for connecting adjacent panels having aligned openings, the apparatus comprising, a pin assembly including:

a) an engagement pin having an attachment end and an engaging end and a longitudinal axis;

b) a latch coupled to the engagement pin and having a locked and an unlocked position with respect to the adjacent panels, wherein the latch being in the locked position the latch overlaps and holds together the adjacent panels and wherein the latch being in the unlocked position the latch does not engage the panels; and c) a biasing member having forward and rearward ends, the biasing member forward end being attached to the attachment end of the engagement pin and wherein the biasing member has a compressed configuration and an expanded configuration, in the expanded configuration: the biasing member, as a result of pin assembly being struck drives the engagement pin engaging end through the aligned openings in the adjacent panels, while the latch is rotated about the longitudinal axis from the unlocked position into the locked position to lock the adjacent panels together.

2. The apparatus set forth in claim 1, when the biasing member is moved from the expanded configuration to the compressed configuration, the latch moves from the locked position to the unlocked position such that the latch disengages the adjacent panels by reverse rotating about the longitudinal axis.

3. The apparatus as set forth in claim 1, wherein the biasing member is located within a housing structure.

4. The apparatus as set forth in claim 3, wherein the rearward end of the biasing member couples to the housing structure.

5. The apparatus as set forth in claim 1, wherein the biasing member is a torsion spring.

6. The apparatus as set forth in claim 2, wherein reverse rotating the latch compresses and tensions the biasing member.

7. An apparatus for connecting adjacent panels, the apparatus comprising:

a) a housing;

b) an engagement pin having a longitudinal axis having an attachment end and an engaging end;

c) a latch coupled to the engagement pin having a locked and an unlocked position with respect to the adjacent panels wherein the latch being in the locked position the latch overlaps and holds together the adjacent panels and whereinin the latch being in the unlocked position the latch does not engage the panels; and d) a biasing member being located within the housing and having forward and rearward ends, wherein the biasing member forward end is attached to the engagement pin on the attachment end, and the rearward end of the biasing member is coupled to the housing, and wherein the biasing member has a compressed configuration and an expanded configuration, in the expanded configuration, the biasing member, as a result of pin assembly being struck, drives the engagement pin through substantially aligned openings in the panels while the latch is rotated about the longitudinal axis from the unlocked position into the locked position to lock the panels together.

8. An apparatus for connecting adjacent panels having aligned openings, the apparatus comprising, a pin assembly including:

a) an engagement pin having an attachment end and an engaging end and a longitudinal axis;

b) a biasing member being located in a housing, and having forward and rearward ends, the forward end being attached to the attachment end of the engagement pin and the rearward end of the biasing member engages the housing, and wherein the biasing member has a compressed configuration and an expanded configuration, when in the expanded configuration the biasing member drives the engagement pin engaging end through the aligned openings in the adjacent panels; and c) a biased catch being located on an inner surface of the housing, and having a groove, such that when the biasing member is in the compressed configuration the groove applies a frictional hold on the biasing member so as to secure the engagement pin attachment end within the housing.

9. An apparatus for connecting adjacent panels, the apparatus comprising:

a) a housing;

b) an engagement pin having an attachment end and an engaging end and a longitudinal axis;

c) a biasing member being located within the housing and having forward and rearward ends, the biasing member forward end is attached to the attachment end of the engagement pin, the rearward end of the biasing member is coupled to a housing and wherein the biasing member has a compressed configuration and an expanded configuration;

d) a latch coupled to the engagement pin having a locked and unlocked position with respect to the adjacent panels, wherein the latch being in the locked position the latch overlaps and holds together the adjacent panels and wherein the latch being in the unlocked position the latch does not engage the panels; when the biasing member is in the compressed configuration, the latch is in the unlocked position and when the biasing member moves from the compressed configuration to the expanded configuration as a result of the apparatus being struck, the biasing member drives the engagement pin engaging end through the aligned openings in the adjacent panels, while the latch rotates about the longitudinal axis from the unlocked position into the locked position to lock the adjacent panels together; and e) a biased catch being located within the housing and being operable to secure the biasing member in the compressed configuration.

10. An apparatus for connecting adjacent panels having aligned openings, the apparatus comprising a pin assembly including an engagement pin and a biasing member, wherein an extension force operable to release the biasing member drives the engagement pin through the aligned openings in the adjacent panels, a rotational force in the biasing member causing a latch to lock the adjacent panels together, the engagement pin having a hollow-tipped forward end.

11. An apparatus for connecting adjacent panels having aligned openings, the apparatus comprising a pin assembly including an engagement pin, a biasing member and a pin insert, wherein an extension force operable to release the biasing member drives the engagement pin through the aligned openings in the adjacent panels, a rotational force in the biasing member causing a latch to lock the adjacent panels together, the engagement pin having a hollow-tipped forward end and wherein the pin insert is coupled to the hollow-tipped forward end of the engagement pin.

12. An apparatus for connecting adjacent panels having aligned openings, the apparatus comprising a pin assembly including an engagement pin with a rearward end and a biasing member, wherein an extension force operable to release the biasing member drives the engagement pin through the aligned openings in the adjacent panels, a rotational force in the biasing member causing a latch to lock the adjacent panels together and wherein the rearward end of the engagement pin is coupled to the housing by an o-ring.

13. An apparatus for connecting adjacent panels having aligned openings, the apparatus comprising a pin assembly including an engagement pin and a biasing member, wherein an extension force operable to release the biasing member drives the engagement pin through the aligned openings in the adjacent panels, a rotational force in the biasing member causing a latch to lock the adjacent panels together, and a wedge for securing and preventing inadvertent retraction of the engagement pin.

14. An apparatus for connecting adjacent panels having aligned openings, the apparatus comprising, a pin assembly including:

a) an engagement pin having an attachment end and an engaging end about a longitudinal axis, the engagement end being hollow and wherein a pin insert is coupled to the hollow engagement end of the engagement pin;

b) a latch coupled to the engagement pin and having a locked and unlocked position with respect to the adjacent panels wherein the latch being in the locked position the latch overlaps and holds together the adjacent panels and wherein the latch being in the unlocked position the latch does not engage the panels;

c) a biasing member having a forward end, the biasing member forward end is attached to the attachment end of the engagement pin and wherein the biasing member has a compressed configuration and an expanded configuration, when moving from the compressed configuration to the expanded configuration as a result of the pin assembly being struck, the biasing member drives the engagement pin engaging end through the aligned openings in the adjacent panels while the latch is rotated about the longitudinal axis from the unlocked position into the locked position to lock the adjacent panels together.

* * * * *